US005429191A

United States Patent [19]

Schmidt et al.

[11] Patent Number: 5,429,191

[45] Date of Patent: Jul. 4, 1995

[54] HIGH-PRESSURE WELL FRACTURING METHOD USING EXPANSIBLE FLUID

[75] Inventors: Joseph H. Schmidt, Anchorage, Ak.; Thomas K. Perkins, Dallas, Tex.; James C. Abel, Anchorage, Ak.; Charles R. Eason, Jr., Englewood, Colo.

[73] Assignees: Atlantic Richfield Company, Los Angeles, Calif.; Dowell Schlumberger Incorporated, Sugar Land, Tex. ; a part interest

[21] Appl. No.: 205,910

[22] Filed: Mar. 3, 1994

[51] Int. Cl.[6] ..... E21B 43/26

[52] U.S. Cl. ..... 166/297; 166/308; 166/311; 166/312

[58] Field of Search ..... 166/297, 308, 311, 312, 166/317

[56] References Cited

U.S. PATENT DOCUMENTS

| | | | |
|---|---|---|---|
| 3,136,361 | 6/1964 | Marx | 166/308 |
| 3,170,517 | 2/1965 | Graham et al. . | |
| 3,200,882 | 8/1965 | Allen . | |
| 3,393,741 | 7/1968 | Huitt et al. . | |
| 4,374,545 | 2/1983 | Bullen et al. | 166/308 X |
| 4,718,493 | 1/1988 | Hill et al. | 166/308 |
| 5,074,359 | 12/1991 | Schmidt | 166/280 |
| 5,131,472 | 7/1992 | Dees et al. | 166/308 |
| 5,265,678 | 11/1993 | Grundman | 166/308 |
| 5,271,465 | 12/1993 | Schmidt et al. | 166/297 |

*Primary Examiner*—George A. Suchfield
*Attorney, Agent, or Firm*—Michael E. Martin

[57] ABSTRACT

Fractures are initiated or extended within an earth formation from a well which includes a tubing string extending to a wellbore space adjacent the fracture zone from a conventional wellhead. Carbon dioxide, nitrogen or a similar highly expansible fluid is pumped into the wellbore space and/or at least a portion of the tubing string at a pressure greater than the fluid critical pressure and greater than the fracture initiation or extension pressure required in the formation zone. A perforating gun is fired or a shear disk is actuated to release the expansible fluid to flow into the formation at an initial velocity and kinetic energy which substantially exceeds that which is obtained with water or similar conventional fracturing fluids so as to initiate or extend hydraulic fractures with a minimum radius of curvature with respect to the wellbore.

8 Claims, 3 Drawing Sheets

HIGH-PRESSURE WELL FRACTURING METHOD USING EXPANSIBLE FLUID

BACKGROUND OF THE INVENTION

1. Field of the Invention

The present invention pertains to a method for fracturing earth formations to stimulate the production of fluids therefrom by over-pressuring the wellbore with an expansible fluid such as dense phase carbon dioxide or nitrogen and initiating the fracture with perforating guns or release of the fluid into the formation through a frangible closure.

2. Background

In hydraulically fracturing earth formations to stimulate the production of fluids therefrom, a long-standing problem has been the inability to sustain high pressure and high flow rates of the fracturing fluid during fracture initiation or extension. In deviated wells, in particular, inadequate pressure/flow conditions at fracture initiation will produce a near wellbore "kink" in the fracture which will tend to restrict the flow of fluids to or from the wellbore once the fracture has been formed. U.S. Pat. No. 5,074,359, issued Dec. 24, 1991 to Joseph H. Schmidt and assigned to the assignee of the present invention, discusses the problem of improper fracture formation from deviated wells, in particular. The '359 patent is directed to a method for orienting the casing perforations to minimize improperly formed fractures at or near the perforations.

Previous efforts have been made to provide sustained high pressure flow of fracturing fluid into a formation to initiate substantial fractures and sustain fracture growth. U.S. Pat. Nos. 3,170,517 to Graham, et al; 3,200,882 to Allen; 3,393,741 to Huitt, et al; and 4,718,493 to Hill, et al all describe hydraulic fracturing methods where a column of liquid is pressurized and released suddenly to act on the earth formation from a perforated well to improve fracture initiation and extension. The Hill, et al patent suggests mixing the fracturing fluid with a proppant and a pressurized gas. Still further, U.S. Pat. Nos. 5,131,472 to Dees, et al and 5,271,465 to Schmidt, et al describe further improvements in over-pressuring the wellbore prior to fracture initiation or extension.

One problem associated with the methodology described in the above-mentioned patents is that the substantial column or quantity of fracturing liquid, usually water which has been treated with a friction-reducing agent such as guar or HPG, resists the high rate of acceleration required to assure a non-kinked fracture and to enhance fracture link-up between vertically spaced wellbore perforations. By placing a column of liquid, such as water, in the wellbore and the well tubing and pressurizing the well tubing above the water column, a substantial quantity of non-expanding liquid, in the amount of twenty-five to thirty tons in a typical well, must be accelerated into the formation through the wellbore perforations. Accordingly, the initial velocity and kinetic energy of this liquid column is difficult to raise to optimum levels to achieve the type of fracture extension and growth desired. It is to this end that the present invention has been developed with a view to improving the initiation and extension of hydraulic fractures using the so-called over-pressured wellbore fracturing methodology described in various aspects in the above-mentioned patents.

SUMMARY OF THE INVENTION

The present invention provides an improved method for fracturing an earth formation from a well by initiating and extending the fracture with a high-pressure expansible fluid.

In accordance with an important aspect of the present invention, hydraulic fractures are initiated and/or extended from a well into which a quantity of expansible fluid has been pumped under a pressure which, preferably, exceeds the critical pressure of the fluid at least prior to initiation or extension of the fracture. In particular, a substantial quantity of fluid, such as carbon dioxide, nitrogen or fluid having certain physical properties similar to dense phase carbon dioxide, is pumped into the wellbore and/or a tubing string extending within the well and fracture initiation or extension is commenced by perforating the well or rupturing a frangible closure member to release the expansible fluid for flow into the formation at an initial velocity and rate of expenditure of energy which will provide improved fractures in the earth formation.

In accordance with yet another aspect of the present invention, an expansible fluid, such as carbon dioxide or nitrogen is introduced into a well for use in initiating and extending fractures in the earth extending from the well and the expansible fluid is maintained in a predetermined range of pressures and temperatures which will cause the fluid to be in a dense phase prior to and following initiation or extension of the fracture. The expansible fluid is maintained at a predetermined pressure prior to fracture initiation and/or extension by pumping a quantity of the fluid into the well and/or a tubing string extending within the well until a predetermined pressure is reached. At least part of the well may be occupied by pressure gas to maintain the pressure of the expansible fluid at a predetermined value or the quantity of expansible fluid introduced into the well may be such as to effect compression of any gas residing in the well, including the tubing string.

The above-mentioned features and other advantages of the present invention will be further appreciated by those skilled in the art upon reading the detailed description which follows in conjunction with the drawing.

DESCRIPTION OF PREFERRED EMBODIMENTS

Figure 1:
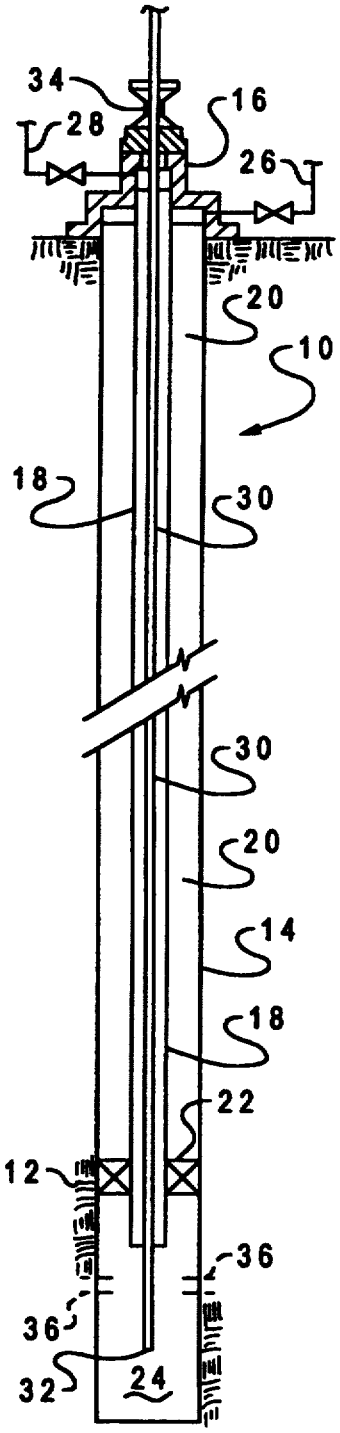
FIGS. 1 through 3 are schematic diagrams of a well which is adapted for fracturing of an earth formation in accordance with the method of the present invention.

In the description which follows, like elements are marked throughout the specification and drawing with the same reference numerals, respectively. The drawing figures are not necessarily to scale in the interest of clarity and conciseness.

Referring to FIG. 1 there is illustrated a well, generally designated by the numeral 10, which has been drilled into an earth formation 12. The well 10 includes a conventional casing 14, wellhead 16 and a so-called production tubing string 18 extending from the wellhead to a point above the bottom of the well, as illustrated. An annular space 20 formed between the casing 14 and the tubing string 18 is isolated by a conventional packer 22 which, together with the casing 14, defines a wellbore space 24 into which the tubing string 18 extends. Suitable fluid-conducting conduits 26 and 28 are in communication with the annular space 20 and the interior of the tubing string 18, respectively, through the wellhead 16. The method of the invention also contemplates that the tubing or tubing string may comprise an open hole well or the casing 14 only and the entire wellbore space from the wellhead to the bottom of the well may be used to contain the fluids described hereinbelow.

The well 10 is, as shown in FIG. 1, in the condition wherein the casing 14 has not been perforated to place the wellbore space 24 in communication with the formation 12 for either the injection of or production of fluids between the formation and the wellbore space. FIG. 1 does illustrate an elongated tubing 30 which has been inserted through the wellhead 16 and the interior of the tubing string 18 and having a distal end 32 disposed in the wellbore space 24 a predetermined distance below the end of the tubing string 18, as indicated. The tubing 30 may be of the so-called coilable type which may be inserted through the wellhead 16 in a conventional manner and withdrawn from the tubing string 18 upon completion of a step in the overall method of the present invention which will be described herein. The tubing 30 is inserted into the wellhead 16 through a conventional movable closure 34. Other conventional elements used in conjunction with insertion and withdrawal of the tubing 30, such as blow-out preventers and the like, are not illustrated.

In preparing the well 10 for extension of a fracture into the earth formation 12 by way of the wellbore space 24, the invention contemplates evacuating the wellbore space 24 of any liquid disposed therein such as drilling fluid or completion brine which has been circulated within the well. For example, it may be desirable to insert the tubing 30 into the well in the arrangement shown in FIG. 1 and then circulate a methanol/water mixture through the wellbore space 24 and back up through the annular space between the tubing string 18 and the tubing 30 to thoroughly clean the wellbore space 24. After circulation of the aforementioned methanol/water mixture, the tubing 30 is connected to a source of pressure gas, such as nitrogen, which is injected into the wellbore space 24 to evacuate liquid in the wellbore space at least a predetermined distance below the points 36 where a suitable number of perforations are to be formed in the casing 14 to place the wellbore space 24 in communication with the earth formation 12. Circulation of the methanol/water mixture, as well as the evacuating gas, may be carried out by conducting the aforementioned fluids down through the annular space between the tubing 18 and the tubing 30 and up through the interior of the tubing 30 or, vice versa.

When substantially all liquid has been evacuated from the well 10 to a point below the perforation point 36, a predetermined fluid pressure may be maintained in the wellbore space 24, nominally about 1000 psig, and the tubing 30 then withdrawn from the well and the closure 34 closed to prevent loss of pressure in the wellbore space.

Figure 2:
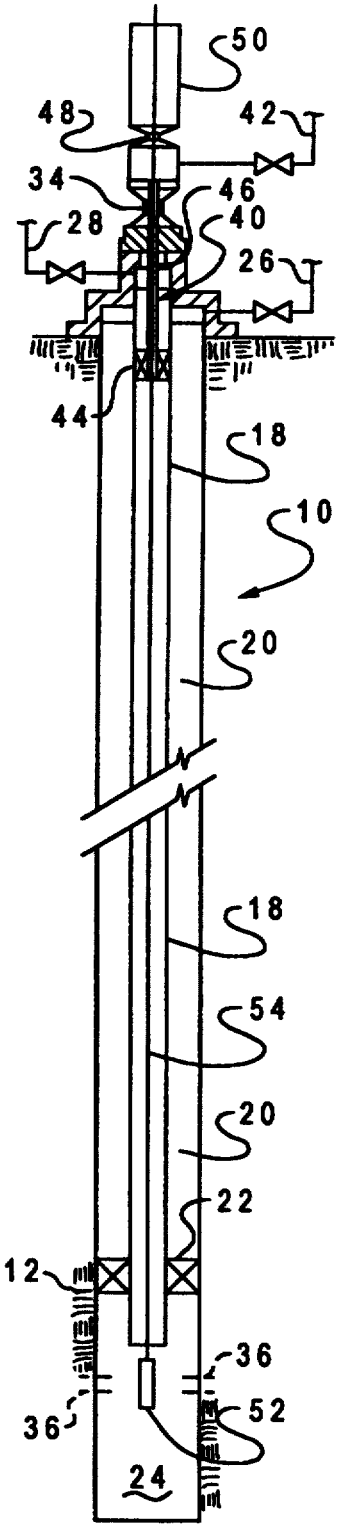

Referring now to FIG. 2, the well 10 is shown in a condition wherein a device 40, sometimes known as a wellhead isolation tool is inserted into the wellhead 16 through the closure 34 to a predetermined point within the tubing 18. The device 40 is adapted to be in communication with a source of high pressure fluid by way of a conduit 42 for communicating that fluid to the interior of the tubing 18 while avoiding exerting high fluid pressures on the wellhead 16. The device 40 may include an inflatable and/or retrievable packer 44 connected to a suitable conduit or tubing 46 extending through the closure 34, as illustrated. Still further, a second closure 48 is installed on the device 40 along with a conventional high-pressure well lubricator 50.

After installation of the aforementioned devices 40, 48 and 50, a conventional perforating device or "gun" 52 is lowered into the wellbore space 24 by way of a suitable cable 54, sometimes called an E-line. The perforating gun 52 is installed in the space 24 in a substantially conventional manner by utilizing the lubricator 50 wherein the gun is installed in the interior of the lubricator before the closure 48 is opened to allow the gun 52 to pass through the tubing 46 and, of course, the tubing 18 to the position shown. The perforation gun 52 may also be conveyed into its firing position shown and withdrawn therefrom on the distal end of coilable tubing such as the tubing 30 and utilizing the method described in U.S. patent application Ser. No. 08/316,985, filed Oct. 3, 1994 by Joseph H. Schmidt, entitled "Over-Pressured Fracturing of Deviated Wells", which application is also assigned to the assignee of the present invention.

After installation of the perforation gun 52 into the position shown in FIG. 2, a suitable expansible fluid having physical properties similar to nitrogen or carbon dioxide in a dense phase, that is in a range of pressures and temperatures above the critical pressure, which may be liquid or gaseous, is pumped into the space 24 by way of conduits 42 and 46 and the conduit 8. The term "liquid" when used herein to describe the expansible fluid is to be taken in the context of the characteristics of carbon dioxide, for example, as it exists in the exemplary range of pressures and temperatures described below which behaves somewhat like a liquid but is also highly expansible. In order to minimize the stresses on the tubing 18, the wellbore space 20 is also pressurized by pumping a suitable fluid into this space by way of the conduit 26 and increasing the pressure proportionately with the pressure of the fluid that is injected into the wellbore space 24 by way of the conduit 18.

Expansible fluid, such as nitrogen or carbon dioxide, is pumped into the wellbore space 24 to substantially occupy that space and at least a portion of the tubing 18 at a pressure and temperature which will essentially maintain the fluid in a dense phase whose behavior may be more like a liquid than a gas. For example, if carbon dioxide is used as the pumped in fluid, a pressure is maintained in excess of the critical pressure and at least equal to or in excess of the fracture extension pressure required based on the in situ stresses in the formation 12.

Figure 4:
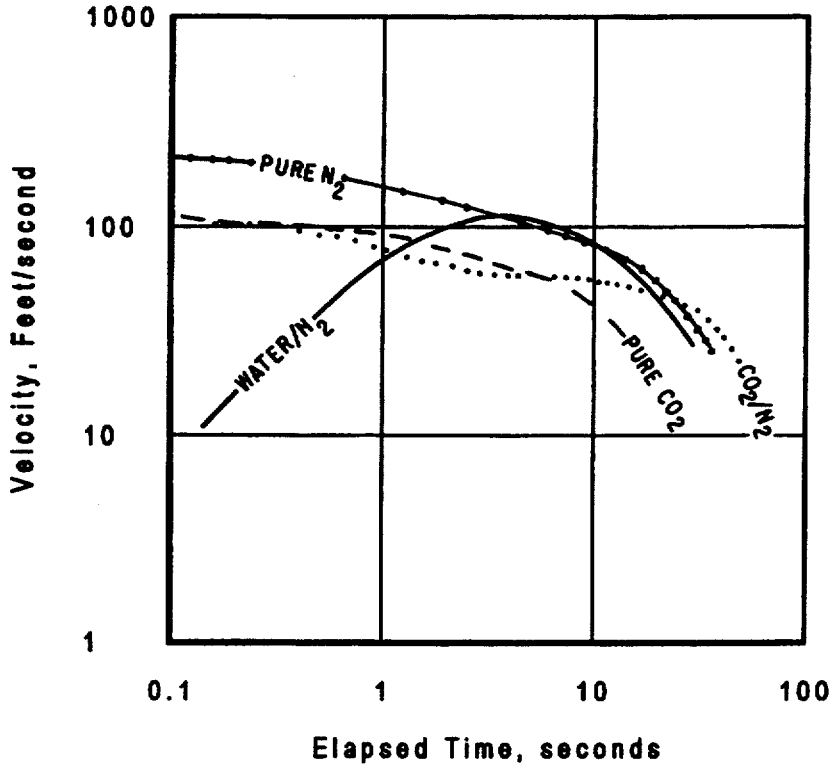
FIG. 4 is a diagram showing the initial fluid velocity exiting from a well tubing for the well of FIGS. 1 through 3 for fracture treatments with water pressurized by nitrogen gas and for fracture treatments with a dense phase expansible fluid.
Figure 5:
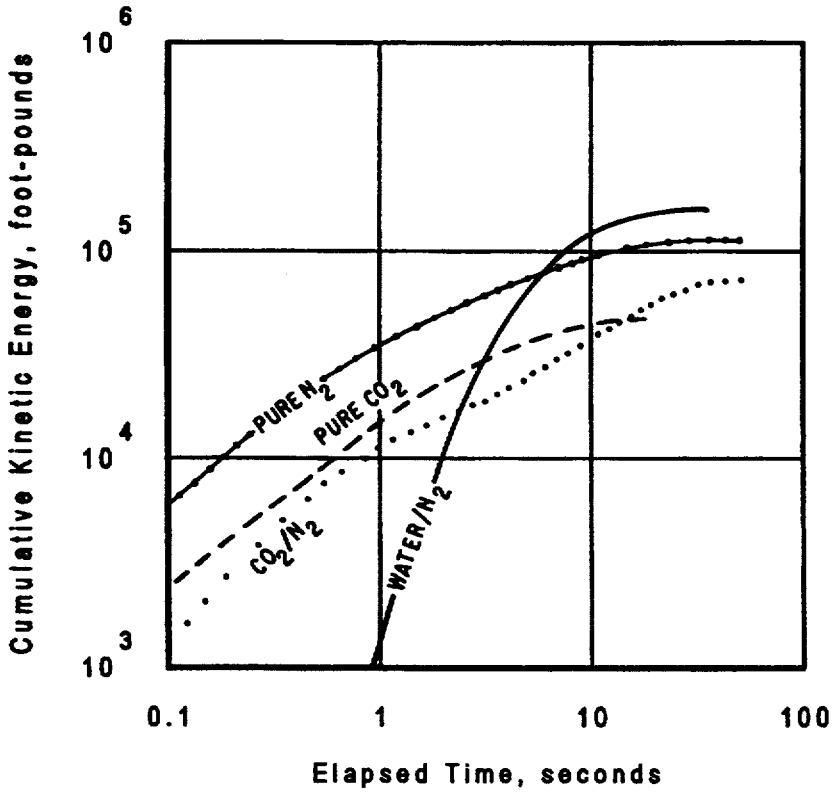
FIG. 5 is a diagram similar to FIG. 4 showing the cumulative kinetic energy of fluid exiting the well tubing as a function of time after initiation of a fracture using the same combinations of fluids shown for FIG. 4.
Figure 7:
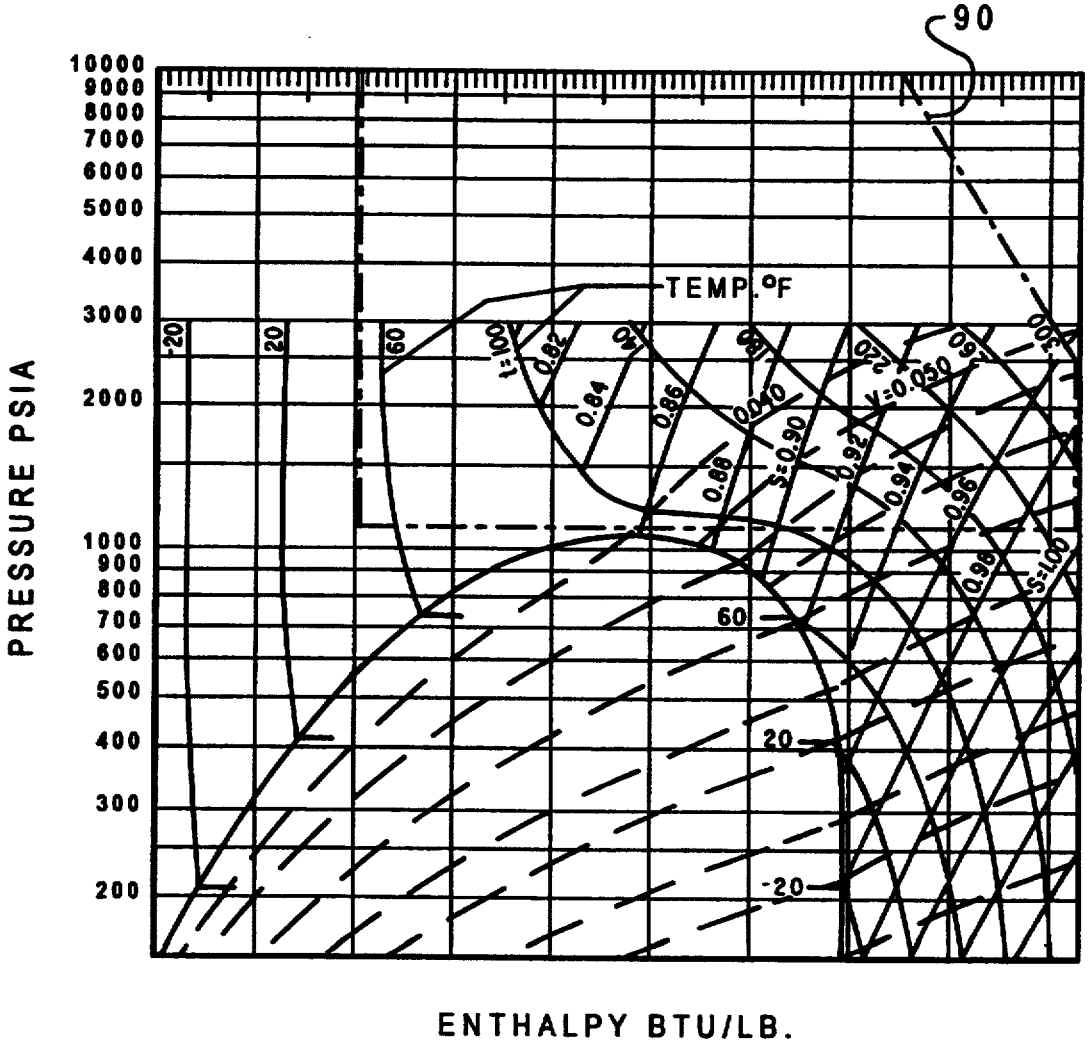
FIG. 7 is a pressure-enthalpy diagram for carbon dioxide.

An important desideratum of the present invention pertains to providing an expansible fluid for use in initiating or extending a fracture which has the same or similar characteristics as so-called dense phase carbon dioxide. Referring to FIG. 7, the heavy lined somewhat trapezoidal shaped box 90 in the pressure-enthalpy diagram for carbon dioxide delimits a range of pressures and temperatures at which carbon dioxide is in a fluid form which may be all liquid or all gas, although the two phases are somewhat ill-defined within this range of pressures and temperatures. In particular, the dense phase box 90 shows a lower temperature limit of about 55° F., an upper limit of about 300° F. and a range of pressures above the critical pressure (1071 psia). Carbon dioxide, at a pressure and temperature condition within the box 90 and existing within the so-called dense phase which carbon dioxide exhibits in this range of pressures and temperatures, has an expansion characteristic which will produce desirable velocities and an initial rate of cumulative kinetic energy delivered as indicated by the diagrams of FIGS. 4 and 5. Fluids, such as nitrogen at pressures above the critical pressure, which exhibit similar, or even greater, initial velocities and initial rates of cumulative kinetic energy are also considered desirable for use in the method of the present invention.

When a predetermined quantity of the expansible fluid is pumped into the wellbore space 24 so as to occupy at least a portion of the tubing 18, the perforation gun 52 may be activated to generate perforations 36, thereby releasing the pressurized fluid in the wellbore space 24 to flow into the formation 12 and initiate and extend a fracture therein.

Figure 3:
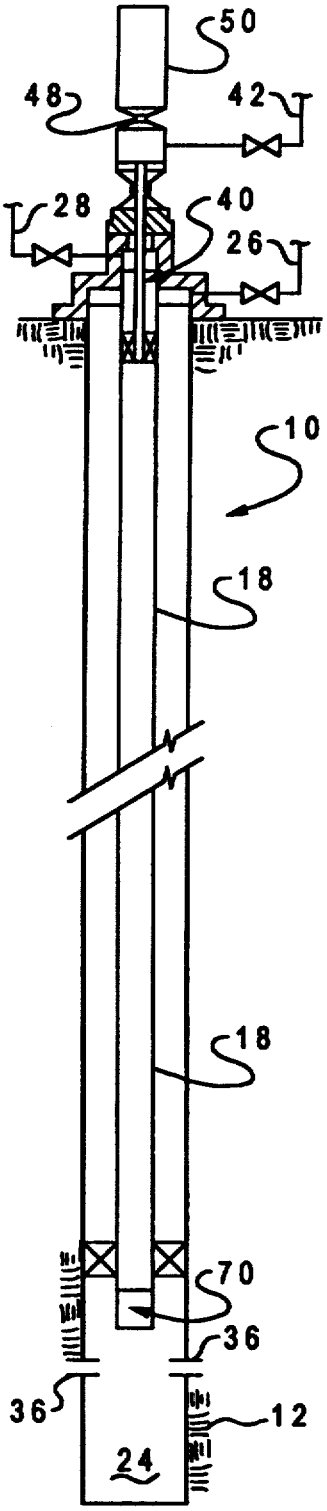
Figure 6:
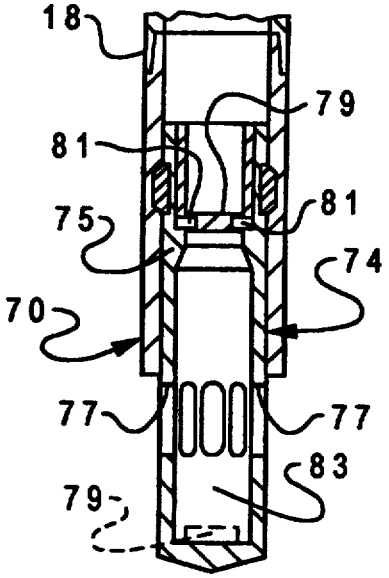
FIG. 6 is a detail view of a frangible closure member for use in the well shown in FIG. 3.

Alternatively, the well 10 may be configured as illustrated in FIG. 3 by modifying the tubing string 18 to have a so-called landing nipple 70 disposed at the lower distal end of the tubing string. The landing nipple 70 is configured to receive a device illustrated in FIG. 6 and comprising a shear disk assembly 74 characterized by a generally cylindrical body 75 having exit ports 77 formed therein and a frangible closure member or disk 79 disposed to block the flow of fluid through the tubing string 18 and the ports 77 into the wellbore space 24. The closure 79 is secured in place and the body 75 by spaced apart shear pins 81, for example. At a predetermined pressure differential acting across the disk 79 the pins 81 will shear to allow the disk to be displaced to the alternate position shown in the space 83 below the ports 77 so that fluid may flow rapidly out of the tubing string 18 through the ports 77 and into the wellbore space 24.

A procedure for loading a quantity of expansible pressure fluid into the well 10 using the frangible closure or shear disk assembly 74 comprises installing the assembly 74 with a coilable tubing or wireline prior to placement of the isolation device 40 into the position shown in FIGS. 2 and 3. After placement of the shear disk assembly 74 in the landing nipple 70, a coilable tube such as the tubing 30 may be inserted in the conduit or tubing string 18 down to a point just above the shear disk assembly and any liquid in the tubing string 18 evacuated in the same manner that liquid is evacuated from the well in the arrangement illustrated in FIGS. 1 and 2. After withdrawal of the liquid evacuating tubing from the tubing string 18 and while maintaining a minimum pressure of gas in the tubing string, such as nitrogen, at about 1000 psig to 3000 psig, the isolation device 40 is installed on the wellhead 16 and expansible fluid is pumped into the tubing string 18 above the shear disk assembly 74 until a predetermined pressure is reached which will effect displacement of the disk 79 to the alternate position shown. The potential energy in the expansible fluid disposed in the tubing string 18 will effect initiation and/or extension of a hydraulic fracture driving some liquid, if any is present in the wellbore space 24, into the formation 12. In the arrangement illustrated and described above with regard to FIG. 3, the perforations 36 have already been formed prior to installation of the shear disk assembly 74 and pressurizing of the tubing 18 with the expansible liquid. The lubricator 50 may or may not be required using the method associated with the arrangement of FIG. 3.

As previously mentioned, an important aspect of the present invention is the delivery of pressure fluid into the formation 12 at high velocity and at a high rate of kinetic energy during the first one (1.0) to five (5.0) seconds and preferably during the first second from when the fluid is exposed to the formation from either forming the perforations 36 or release of the frangible closure disk 79. FIGS. 4 and 5 illustrate the advantages of the use of an expansible fluid such as carbon dioxide or nitrogen disposed in the wellbore space 24 and/or the tubing string 18. FIG. 4 illustrates the fluid velocity exiting the tubing string 18 for the tubing diameter and other conditions given for the example set forth hereinbelow and for a situation wherein the wellbore space 24 and a portion of the tubing string 18 is filled entirely with carbon dioxide or nitrogen (curves in FIGS. 4 and 5 referenced as Pure $CO_2$ and Pure $N_2$, respectively).

FIGS. 4 and 5 also both illustrate the fluid characteristics where the wellbore space 24 and at least a portion of the tubing string 18 are filled with carbon dioxide and the remainder of the space in the tubing string 18 between the carbon dioxide and the wellhead 16 is filled with pressure nitrogen (dotted line curve labelled in FIGS. 4 and 5 as $CO_2N_2$) again at the conditions given for the example hereinbelow. Lastly, FIGS. 4 and 5 show a curve which is labelled Water/$N_2$ which is the performance characteristics of the arrangement wherein the wellbore space 24 and a portion of the tubing string 18 are filled with water (which may include a small amount of a gel such as guar or HPG to reduce friction losses) which is under pressure of nitrogen gas in the tubing string 18 between the level of the water in the tubing string and the wellhead 16.

FIG. 5 indicates that the cumulative kinetic energy exiting the tubing 18, and which is proportional to the energy delivered into the formation 12, in the first second of elapsed time from either firing of the perforation gun 52 or failure of the shear disk 79, is superior for the condition wherein the well 10 is filled with pure nitrogen or either pure carbon dioxide or carbon dioxide under pressure of nitrogen. In like manner, as shown in FIG. 4, the fluid velocity exiting the tubing 18, and which is proportional to the velocity of the same fluid entering or flowing through a fracture, is substantially greater in the first second of elapsed time for dense phase nitrogen or carbon dioxide or nitrogen over carbon dioxide even though the maximum velocity of water under pressure of nitrogen eventually reaches a value similar to the values of the nitrogen alone. Of course, the total cumulative kinetic energy expended in initiating and propagating the fracture is also superior for water under the urging of nitrogen. However, an important aspect of the invention is that the cumulative kinetic energy expended in the first second of elapsed time from initiation or extension of the fracture and the initial velocity of the fluid which is initiating or extending the fracture be as great as possible. FIGS. 4 and 5 indicate a clear superiority of the dense phase nitrogen or carbon dioxide for these important parameters. The choice between using carbon dioxide or nitrogen as the expansible fluid may depend on bottom hole hydrostatic pressure limits or requirements and the effect of the more dense fluid, carbon dioxide, on wellbore structures, for example.

The conditions under which the calculations for fluid velocity and cumulative kinetic energy of the various fluids indicated in FIGS. 4 and 5 are as follows, the tubing nominal inside diameter for the tubing string 18 is assumed to be 5.0 inches. The initial wellhead pressure of the fluid in the tubing string 18 and the space 24 is 7,500 psig. It is assumed that the tubing 18 extends 8,850 feet from the wellhead 16 to the distal end of the tubing string extending within the wellbore space 24. The level of fracturing fluid in the tubing string 18, for an arrangement according to FIGS. 1 and 2 is assumed to be 5,150 feet from the wellhead 16 and it is assumed that the pressure required to initiate or extend a fracture in the formation 12 is 5,700 psig. The initial gas or fluid temperature in the wellbore is assumed to be 70° F. (constant) and it is assumed that there are no frictional losses or flow resistances present by virtue of the existence of the perforations 36 or the shear disk assembly 74.

The method of initiating or extending fractures in an earth formation using carbon dioxide under the conditions described herein, is believed to be readily understandable to those of ordinary skill in the art from the description hereinabove. The superiority of the use of dense phase carbon dioxide as a fracturing fluid in the method of the invention has provided an unexpected result as indicated by the diagrams of FIGS. 4 and 5 with regard to initiating or extending hydraulic fractures in earth formations while gaining the advantages described in U.S. Pat. No. 5,074,359. Under certain operating conditions fracture proppant such as conventional fracturing sand or sand mixed with water and dispersants or viscosifiers may be added to the expansible fluids. Friction reducing, and fluid leakoff control agents may also be included in the fracturing fluids. Moreover, formation treatment fluids such as hydrochloric acid may also be added to the expansible fracturing fluid in amounts up to twenty percent (20%) by volume, for example.

Although preferred embodiments of the invention have been described in detail hereinabove, those skilled in the art will recognize that various substitutions and modifications may be made without departing from the scope and spirit of the invention as recited in the appended claims.

What is claimed is:

1. A method for initiating or extending a fracture in an earth formation from a well penetrating said formation, said well having a tubing string extending therewithin from a wellhead into a wellbore space, comprising the steps of:

inserting a length of tubing through said wellhead and said tubing string and evacuating liquid from said wellbore space;

installing an isolation tool on said wellhead to minimize the fluid pressure exposed to said wellhead from said tubing string;

inserting a perforating tool into said well through said isolation tool and said tubing string to a predetermined position in said wellbore space;

pumping an expansible fluid into said tubing string and said wellbore space at a pressure greater than the critical pressure of said expansible fluid and at a temperature so as to maintain substantially all of said expansible fluid in a dense phase and continuing the pumping of said expansible fluid to maintain the pressure of said expansible fluid in said wellbore space at a pressure above the critical pressure and above a pressure required to initiate or extend a fracture into said formation from said wellbore space; and after a predetermined period of time, initiating perforations in said well into said formation to allow said expansible fluid to flow into said formation to extend a fracture having a minimum radius of curvature in the vicinity of said well.

2. The method set forth in claim 1 including the step of:

providing said expansible fluid as carbon dioxide.

3. The method set forth in claim 2 including the step of:

maintaining said carbon dioxide at a pressure greater than 1071 psia and at a temperature of from about 60° F. to 300° F.

4. The method set forth in claim 1 including the step of:

providing said expansible fluid as nitrogen.

5. A method for initiating or extending a fracture in an earth formation from a well penetrating said formation, said well having a tubing string extending therewithin from a wellhead into a wellbore space, comprising the steps of:

installing a closure in said tubing string between said wellhead and said wellbore space;

inserting a length of tubing through said wellhead and said tubing string and evacuating liquid from said tubing string;

pumping an expansible fluid into said tubing string at a pressure greater than the critical pressure of said expansible fluid and at a temperature so as to maintain substantially all of said fluid in a dense phase and continuing the pumping of said expansible fluid to maintain the pressure of said expansible fluid in said wellbore space at a pressure above the critical pressure and above a pressure required to initiate or extend a fracture into said formation from said wellbore space; and causing said closure to release said expansible fluid to flow into said formation to extend a fracture having a minimum radius of curvature in the vicinity of said well.

6. The method set forth in claim 5 including the step of:

providing pressure fluid at a pressure in said tubing string sufficient to maintain the pressure of said expansible fluid greater than the critical pressure thereof.

7. The method set forth in claim 5 including the step of:

providing said expansible fluid as carbon dioxide.

8. The method set forth in claim 5 including the step of:

providing said expansible fluid as nitrogen.

* * * * *